US006105937A

United States Patent [19]

Hay

[11] Patent Number: 6,105,937

[45] Date of Patent: Aug. 22, 2000

[54] FENCE WIRE STRETCHER HAVING STRAND HOLDER FOR PERMITTING REPEATED OPERATIONS OF STRAND TENSIONING CARRIER

[76] Inventor: Patrick James Hay, R.R. #1, Pipestone, Manitoba, Canada, R0M 1T0

[21] Appl. No.: 09/196,436

[22] Filed: Nov. 20, 1998

[30] Foreign Application Priority Data

Dec. 8, 1997 [CA] Canada ..... 2224030

[51] Int. Cl.[7] ..... B21F 9/00

[52] U.S. Cl. ..... 254/237; 254/245; 254/247; 254/252; 254/253; 254/262

[58] Field of Search ..... 254/237, 238, 254/245, 246, 247, 251, 252, 253, 254, 256, 257, 262

[56] References Cited

U.S. PATENT DOCUMENTS

| | | | |
|---|---|---|---|
| 446,790 | 2/1891 | Ridder et al. | 254/237 |
| 775,469 | 11/1904 | Epperson | 254/237 |
| 974,228 | 11/1910 | Boe | 254/238 |
| 1,147,655 | 7/1915 | Snelling | 254/237 |
| 1,179,825 | 4/1916 | Greutmann | 254/237 X |
| 1,231,552 | 7/1917 | Anderson | 254/245 |
| 1,488,043 | 3/1924 | Goodman | 25/237 |
| 1,656,319 | 1/1928 | Cowley | 254/237 |
| 1,781,622 | 11/1930 | Williams | 254/237 |
| 1,792,535 | 2/1931 | Greutman . | |
| 2,519,832 | 8/1950 | Greutman . | |
| 2,937,851 | 5/1960 | Greutman . | |
| 3,825,228 | 7/1974 | Greutman . | |
| 5,687,955 | 11/1997 | Bonser et al. | 254/237 |

*Primary Examiner*—Donald P. Walsh
*Assistant Examiner*—Emmanuel M. Marcelo
*Attorney, Agent, or Firm*—Miles & Stockbridge P.C.; John C. Kerins

[57] ABSTRACT

A wire clamp device affixed to an outer end of a bar in a wire tightener of the type having a stationary wire holding clamp at an opposite end of the bar. A carrier is mounted on the bar and is also provided with a wire holding clamp. The bar is provided with a jack rack and the carrier has a jack mechanism for forcibly driving the carrier toward the first wire holding clamp so as to pull end portions of two strands of wire held by the two wire holding clamps toward each other. The wire clamp device which also has a wire holding clamp is positioned to hold the strand held by the wire holding clamp of the carrier after it has been drawn towards the first wire holding clamp so that the wire holding clamp on the carrier may be released to allow the carrier to be reset to a position near the wire clamp device, after which the wire holding clamp on the carrier is again activated to grasp again the tightened strand which it had previously held. The carrier can again be driven toward the stationary wire holding clamp at the opposite end after release of the strand from the wire clamp device. The presence of the wire clamp device makes it unnecessary to temporarily fasten the strand being tightened by movement of the carrier in order to allow the carrier to be reset to a position for further tightening of the strand.

8 Claims, 5 Drawing Sheets

FENCE WIRE STRETCHER HAVING STRAND HOLDER FOR PERMITTING REPEATED OPERATIONS OF STRAND TENSIONING CARRIER

FIELD OF THE INVENTION

This invention relates to a device for tightening wire and the like, and more particular to an improved device for stretching a single strand, such as a strand of barbed-wire, either when erecting a new fence or in fence repair.

BACKGROUND ART

It is imperative when stretching new fence wire prior to fastening it to posts, or when joining opposite ends of strands of wire, such as when building a fence or repairing it, to utilize some type of a tightener for pulling each strand of wire to ensure the wires making up the fence will be sufficiently taut to effectively retain livestock. Various types of stretchers have been in use for many years, and it is possible to presently purchase stretchers basically of the type shown in U.S. Pat. No. 1,792,535, Feb. 17, 1931 and U.S. Pat. No. 2,519,832, Aug. 22, 1950, both of Greutman. Because of certain operating difficulties experienced with tighteners shown in the above patents, which are described in more detail below, there were developed stretchers which include a considerable more elaborate jack or carrier member, such as shown in later U.S. Pat. No. 2,937,851, May 24, 1960, Greutman et al. and U.S. Pat. No. 3,825,228, Jul. 23, 1974, Greutman. Stretchers of one or both of these patents have also experienced wide use. With the known types of stretchers, operating conditions are frequently encountered with which it is difficult to cope and which at times prove dangerous.

As is shown as being common to the embodiments of all four patents above, there is fixed at one end of a rigid notched bar or rack a wire clamp, and a jack portion or carrier, which includes a second wire clamp, is adapted to be ratcheted along the rack of the bar toward the fixed clamp. When this type of stretcher is being used to join opposed ends of two separate strands, which is common practice when rejoining the separate parts of a broken strand, one strand is held adjacent its end by the fixed clamp, and the other strand is held adjacent its end by the clamp of the carrier. Thus, the ends are brought together by the movement of the carrier towards the fixed clamp. However, often to fully tighten the strands of wire, the carrier must be moved so close to the fixed clamp that there is very limited room therebetween, such as only 4 to 6 inches, thus making it difficult, if not impossible, to properly join the ends of the two strands. If the proper connection cannot be made, it is the common practice to twist the wires into a temporary connection, so that the clamp of the carrier can be released to allow the carrier to be backed off along the rack or otherwise reset to a position where the clamp on the wire can be remade. The carrier can then be advanced again towards the fixed clamp to provide some extra lengths at ends which can be used to form a better permanent connection between the ends before releasing both the fixed clamp and the clamp of the carrier.

When new fence wire is being stretched to a post, it is usually necessary to temporarily join the end of the wire to the post more than once so as to allow the carrier to be moved back for resetting to the free end of the rack where it is reclamped to the wire and jacked to the opposite end again for further tightening of the strand of wire. Such setting and resetting of the carrier is required, possibly more than once, because with new wire it is not uncommon for the wire to stretch 3 to 5 feet.

It can be seen, therefore, that not only is the making of a temporary connection between the free ends of two strands of wire or the making of a temporary connection of one strand to the post time consuming, but occasionally the temporary connection does not prove sufficiently strong, and the breaking of the connection on release of the clamp of the carrier can be dangerous, not only to the operator of the device, but anyone standing in the vicinity of the tensioned strand.

In the embodiments of the stretchers shown in above-identified U.S. Pat. Nos. 2,937,851 and 3,825,228, as compared to the earlier designs, the carrier was modified to include more parts, including an additional pawl which allows the carrier to be released in a manner to allow it to be backed off at a slower rate. The modified structure is more complex and thus more costly to produce. Also while with careful use, it can reduce the possibility of a break of the connection sometimes caused by a fast release, it does not provide a solution to the problem of having to make one or more temporary connection of the strand held by the clamp of the carrier, so that strand can be released to reset the carrier. As indicated such reset is frequently carried out by backing the carrier from the fixed clamp when the strand is not sufficiently taut for making a permanent connection or when there is not sufficient room between the carrier in its final position and the fixed clamp to make a proper permanent connection. Moreover, users of the modified structure which includes the additional pawl have found that it is awkward and sometimes frustrating to get into a position so as to be able to conveniently use both hands at the carrier as is necessary to activate the extra pawl.

SUMMARY OF THE INVENTION

It is an object of the present invention to provide an improved form of a fence stretcher of the type generally shown in the above identified patents but which is capable of permitting convenient, quick and safe control of resetting the carrier for the purpose of applying additional tension to the strand of wire being tightened or for providing more room to form a proper connection between the ends of two strands carried by the carrier and the fixed clamp of the stretcher.

Accordingly, there is provided a wire clamp device for use in a strand tightener of the type for tightening fence wire and the like. The strand tightener maybe of a known type which includes an elongated rigid bar providing a jack rack at least through an intermediate portion between opposite ends, a strand holding means affixed to the bar adjacent one end of the bar, and a carrier having means for mounting it on the intermediate portion of the bar for movement therealong. The carrier includes a jack mechanism engageable with the jack rack for forcibly driving the carrier in a direction towards the holding means, and the jack mechanism has a release means for allowing return of the carrier away from the holding means. Each of the holding means and the carrier has a projecting portion forming aligned strand receiving channels therein. The carrier has a first clamp for holding a first strand in the channel thereof and exerting a pull force on that strand at least in a direction towards the holding means. The holding means has a second clamp means independently operable a for holding a second strand in the channel thereof for exerting a pull force on the second strand at least in a direction toward the carrier.

The wire clamp device of the present invention includes a body portion provided with securing means for rigidly fastening the device in an operative position adjacent the second end of the bar of the tightener. The device includes a projection portion extending away from the bar when the device is affixed to the bar and which defines a strand receiving channel for substantial alignment with the channels of the holding means and the carrier. A strand clamping means is carried by the body of the device for holding the first strand in the channel thereof and exerting a pull force on the second strand in a direction towards the holding means. The clamping means of the device is manually operable independent of the clamp means of both the holding means and the carrier.

According to another aspect of the present invention, there is provided a method of tensioning a strand by way of a strand tightener, the strand tightener being of the type including an elongated rigid bar providing a jack rack throughout at least an intermediate portion between opposite ends thereof, an anchor means affixed to the bar adjacent one end of the bar, and a carrier having means for mounting the carrier on the intermediate portion of the bar for slideable movement along the bar. The carrier includes a jack mechanism engageable with the jack rack for forcibly driving the carrier in a direction towards the anchor means, the jack mechanism having a jack release means for allowing free return of the carrier in a direction away from the anchor means. Each of the anchor means and the carrier includes a projecting portion extending outwardly from a longitudinal axis of the bar, the projection portion of the carrier forming a channel extending substantially parallel to the bar for receiving a strand to be tightened. The carrier also includes a strand holding means for holding the strand in the channel thereof for exerting a pull force on the strand at least in a direction towards the anchor means. The anchor means includes holding means for attachment of the strand tightener to a member at the strand tightening site to resist movement of the bar in a direction towards a second end thereof opposite to the one end of the bar. The method comprises the steps of:

1) affixing a clamp device to the bar adjacent the second end of the bar, the clamp device comprising a body portion, a projecting portion extending away from the body portion and defining a strand receiving channel for substantial alignment with the channel of the carrier when the body portion is affixed to the bar, and a strand clamping means carried by the body for holding the strand in the channel of the clamp device and exerting a holding force on the strand at least in a direction towards the anchor means;
2) connecting the holding means of the anchor means to the member at the strand tightening site;
3) positioning the carrier on the bar adjacent the clamp device;
4) inserting the strand into the channel of the carrier and engaging the strand holding means of the carrier to prevent movement of the strand in a direction towards the second end of the bar;
5) operating the jack mechanism to move the carrier means towards the one end of the bar to thereby draw the strand in a strand tightening direction towards the anchor means;
6) ensuring entry of the strand into the strand receiving channel of the clamp device and activation of the clamping means of the clamp device for preventing movement of the strand in a direction opposite to the strand tightening direction;
7) independently releasing the strand holding means of the carrier;
8) repeating steps 3) and 5) while ensuring at least partial release of the clamping means of the clamp device to allow the strand to pull through the clamp device;
9) repeating step 7);
10) repeating steps 8) and 9) until the strand is sufficiently tightened;
11) releasing the strand holding means of the carrier;
12) securing the strand to the member at the strand tightening site;
13) subsequently releasing the clamp means of the clamp device; and
14) releasing the holding means of the anchor means from the member, at the strand tightening site for allowing removal of the strand tightener from the strand tightening site.

BRIEF DESCRIPTION OF THE DRAWINGS

In the accompanying drawings which show a specific embodiment of the invention, as an example.

DESCRIPTION OF PREFERRED EMBODIMENT

Figure 1:
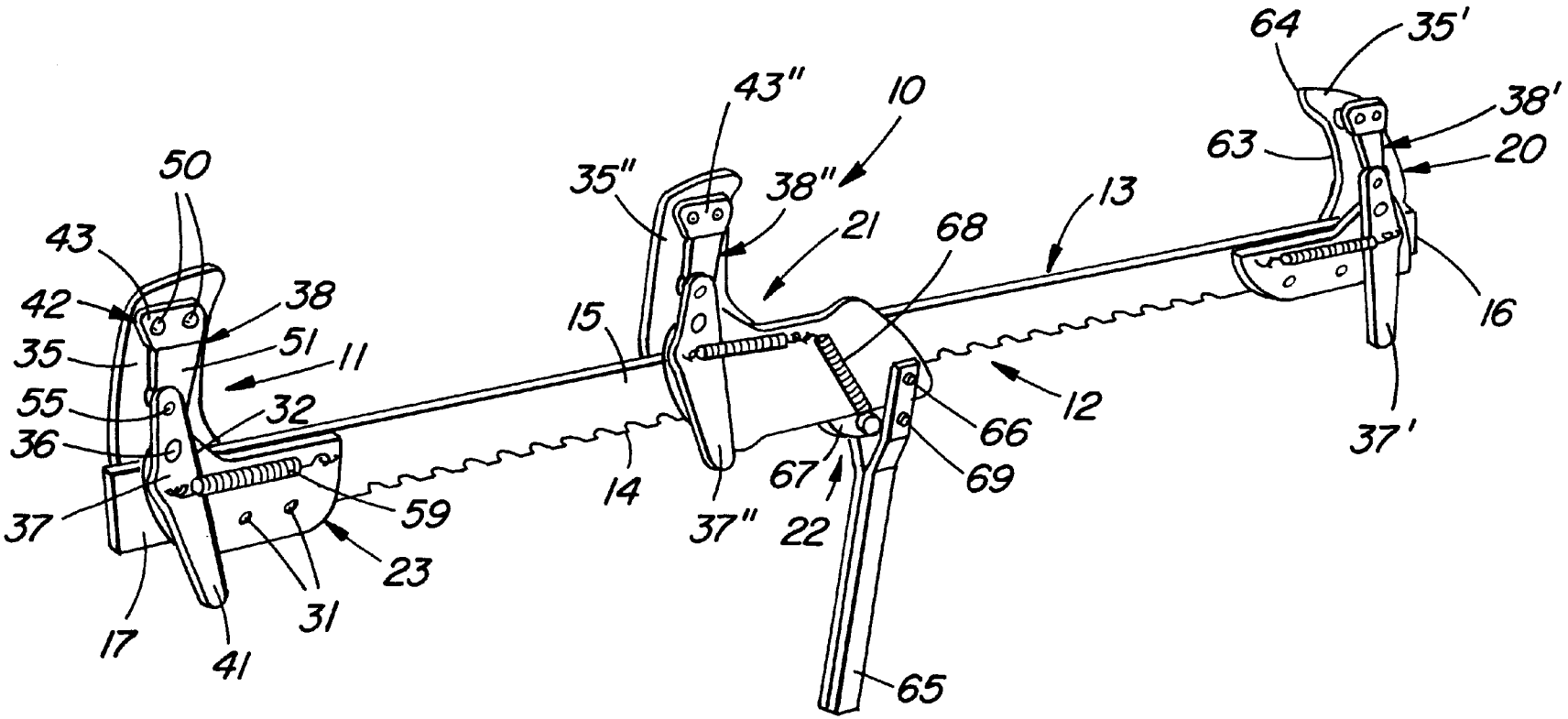
FIG. 1 is a perspective view of a strand tightener with the wire clamp device of the present invention attached to the left end thereof as shown in this Figure.

Referring to the figures of drawings in which reference characters are used to denote like parts referred to hereunder, the reference character 10 denotes an overall structure of the wire clamp device 11 and strand tightener 12 combination. The strand tightener 12 may be of the same or similar structure of strand tighteners which have been available for a number of years and are presently available on the market. It includes a rigid elongated bar 13 having a plurality of teeth forming a jack rack 14 along one edge thereof and extending throughout at least the intermediate portion 15 of the bar 13 between opposite ends 16 and 17. The strand tightener 12 has a strand holding means 20 permanently affixed to the bar 13 adjacent the end 16 thereof and a carrier 21 which includes a jack mechanism 22 engageable with the jack rack 14 for forcibly driving the carrier 21 towards the end 16 on which the strand holding means 20 is stationarily fastened.

Figure 4:
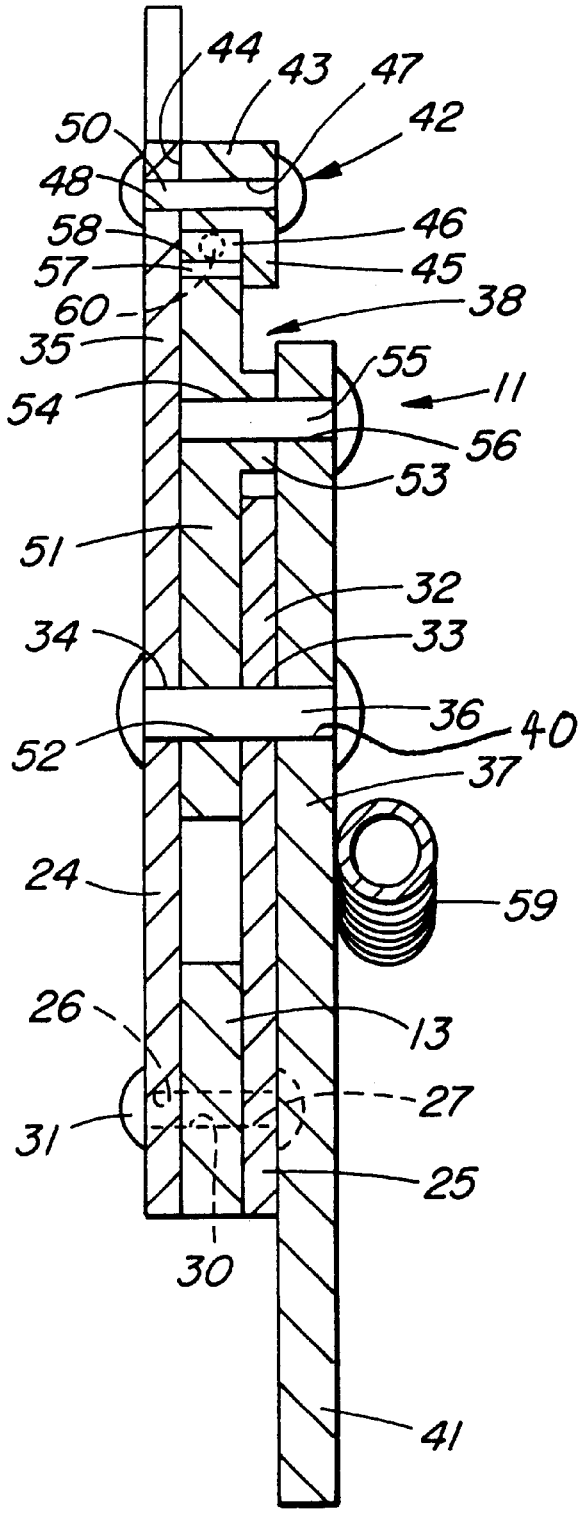
FIG. 4 is an enlarged cross-sectional view of the wire clamp device of the present invention as seen from the line IV—IV of FIG. 3.

While the entire structure 10, which includes the wire clamp device 11 and the strand tightener consisting of the bar 13, strand holding means 20 and carrier 21 may be manufactured and marketed as a unit, the wire clamp device can be sold as a separate product for attachment to the end 17 of the bar 13 in an existing strand tightener of the type shown or one similar thereto. The wire clamp device 11, which also forms a strand holding means, includes a body portion 23 formed by a pair of plates 24 and 25 (FIG. 4). The plates have near the bottom thereof aligned bores 26 and 27 which permit attachment to the bar 13 adjacent its end 17.

The holes 26 and 27 are adapted to align with a hole 30 in the bar so as to receive a rivet, bolt or like fastener 31 for rigidly connecting the wire clamp device 11 to the bar 13 at end 17. More than one such fastener 31 may be provided to ensure a rigid connection of the clamp device 11 to the bar 13.

The plate 25 which forms the front plate of the body portion has a relatively low profile except for a raised section 32 at its outside end which is provided with a bore 33 aligned with a bore 34 in an upward projecting portion 35 of the plate 24 which forms the back plate of the body portion 23, the bores 33 and 34 receiving a pivot pin 36. Mounted on a front end of the pivot pin 36 adjacent a front face of the plate 25 is a handle 37 which allows manual operation of a strand clamp means 38 of the wire clamp device 11. The pivot pin 36 is received in a bore 40 near the upper end of the handle 37. A downwardly depending portion 41 of the handle 37 can be grasped for pivoting the handle, thus forming a lever having the pivot pin 36 as its fulcrum.

Adjacent the top of the upwardly projecting portion 35 of the back plate 24 there is provided on the front face thereof a wire receiving means 42, in the form of a block 43 having a plate engaging surface 44 at one face thereof and a downwardly depending flange 45 at the outer face thereof to form a downwardly open, wire receiving channel 46 between the flange 45 and the front face of the back plate 35. The block 43 is provided with bores 47 which align with bores 48 in the upwardly projecting portion 35 of the back plate 24. Fastening member 50,50, such as rivets or screws connect the block 43 to the back plate 24.

A dog member 51 has a lower portion thereof disposed between the raised section 32 of the front plate 25 and the back plate 24, the lower portion of the dog member 51 being provided with a bore 52 which receives pivot pin 36. On a front face of the dog member 51 there is provided an embossment 53 into which extends a bore 54 receiving a pin 55. The pin 55 also extends through a bore 56 in an upper extension of the handle 37 to provide a pivot connection between the handle 37 and the dog member 51. The dog member has an upper portion moveable into the channel 46 and providing a slanted upper surface 57 terminating in a sharp edge 58 at the side towards the carrier 21. A tension spring 59 has one end fastened to the body portion 23 of the wire clamping device 11 and the opposite end fastened to the handle 37 for biasing the handle in a counter-clockwise direction as viewed in FIG. 1. Thus the spring force is transmitted from the handle 37 through the pin 54 and thereby biases the dog member 51 to pivot about the pivot pin 36 also in a counter-clockwise direction. This in turn forces the upper surface 57 up into the channel 46. On the other hand, if the handle is manually turned clockwise against the tension of the spring, the upper portion of the dog member 51 is pulled in a direction out of the clamping position within the channel 46. Due to the relationship of the pivot axis of the dog member in relation to the underside of the block 43 and the fact the upper surface of the dog member 51 is slanted upward in a direction toward the carrier 21, the clamping effect on a strand 60 of wire in the channel 46 is such that the tension on the strand 60 in a direction away from the carrier 13 causes the engaging edge 58 to bite more tightly into the strand. In other words the design of the wire clamp device 11 is to provide the most effective holding or pull on the strand in a direction towards the carrier 21, thereby preventing the strand from withdrawing in the opposite direction, i.e., in a direction away from the carrier device. It is apparent that other types of strand clamp means could be used in the structure of the wire clamp device 11, but it is essential such means is capable of providing a pull force on the clamped strand at least in a direction towards the carrier 21 (see arrow A) and thus towards the strand holding means 20 also.

Figure 2:
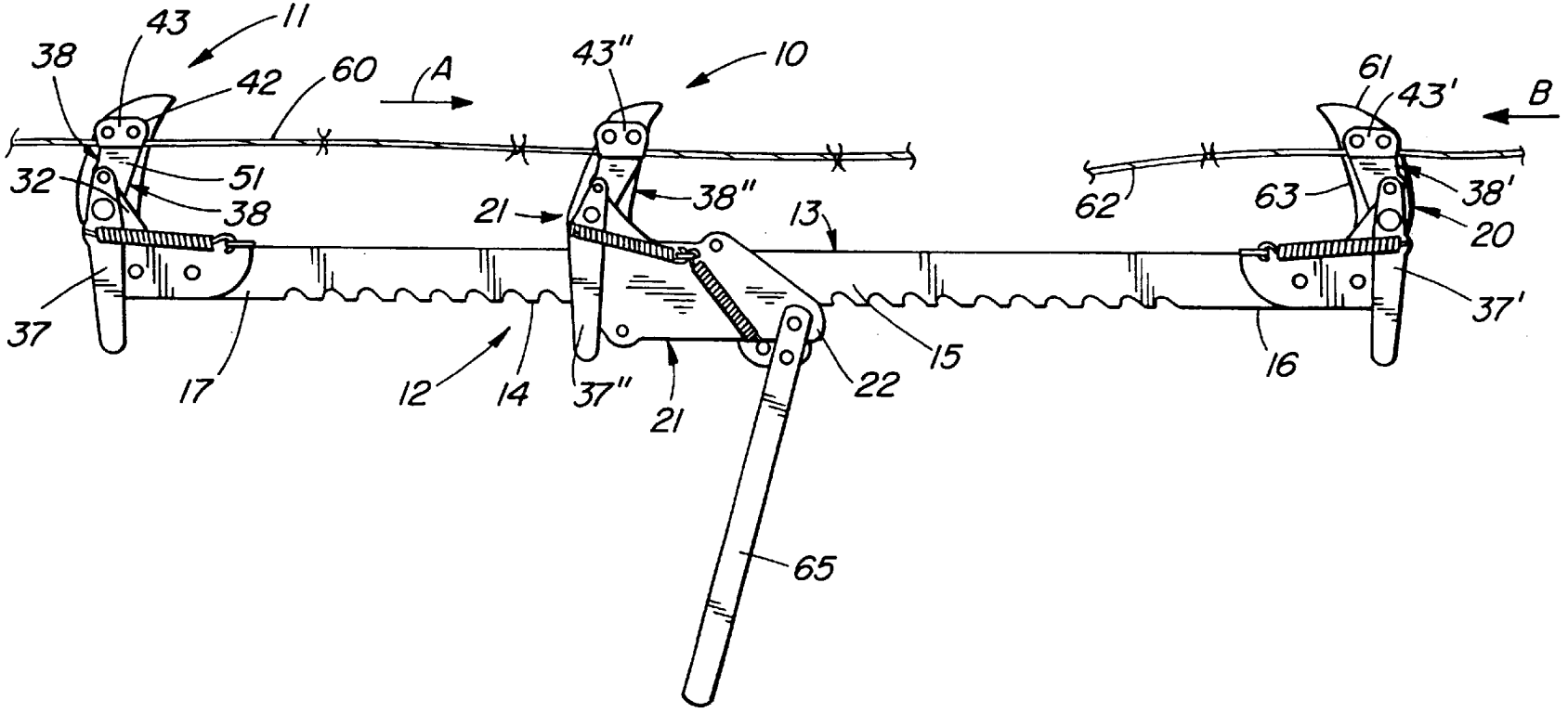
FIG. 2 is a side view of the overall structure including a combination of the device and strand tightener, as shown n FIG. 1, and including ends of two strand of barbed wire held in such structure during an operation of joining the ends.

As previously described, the strand holding means 20 is affixed to the bar 13 at the opposite end 16 of the bar. It is provided with a projecting portion 35' which extends away from the bar in a direction substantially normal to the bar 13, and it may have a strand clamp means 38' of a design similar to that described in relation to that of the wire clamp device. For example, it may include near its outer extremity a block 43' which forms a strand receiving channel. As shown in FIG. 2 an end portion of another strand 62 is received in such a strand clamp means 38' which has a manually operable handle 37' and is designed so as to exert a pull force in a direction (see arrow B FIG. 2) opposite to strand clamp means 38 of the wire clamp device 11, i.e. in a direction from end 16 of the bar 13 towards the carrier 21. The projecting portion 35' of the strand holding means 20 preferably has a curved edge 63 facing the carrier 21 to facilitate the use of the structure 10 in the attachment of a strand of wire to a post as will be described in more detail below. The curve 63 terminates in a slightly in-turned point 64.

The carrier 21 includes, in addition to the jack mechanism 22, a projecting portion 35" also provided with a strand clamp means 38" including a manually operable handle 37" and a block 43" providing an inverted wire strand receiving channel as well. Again the strand clamp means 38" may be of the same type of structure as that described in relation to the wire clamp device 11. Like the clamp means 38 of the wire clamp device 11, it is designed to effect a pull force on the end portion of the strand 60 at least in the direction of arrow A, i.e. in a direction toward the strand holding means 20. The jack mechanism 22 of the carrier 21 may be of any known design for ratcheting the carrier along the intermediate portion 15 of the bar 13. As shown n FIG. 1, for example, the jack mechanism includes a handle 65 pivotally connected to the carrier 21 by a pivot pin 66, and a pawl 67 is pivotally connected to the handle 65 by a pin 69, the pawl 67 being biased into a tooth engaging condition of the jack rack 14 by a spring 68. Swinging of the handle 65 in a to and fro motion by an operator of the strand tightener 12 forces the carrier in a step-by-step motion towards the strand holding means 20. By manually disengaging the pawl 67 from the jack rack 14, the carrier can be slid towards the wire clamp device 11.

Referring to FIG. 2 there is illustrated a condition in which the opposing end portions of two different strands 60 and 62 of a barbed wire are being drawn together by a strand tightener 12 which includes the wire clamp device 11 of the present invention. Such a condition occurs, for example, when repairing a fence line having a broken strand. To begin the operation the end portion of the strand 62 is clamped into the strand clamping means 38' of the strand holding means 20, and with the carrier 21 backed to a position adjacent the wire clamp device 11 at the opposite end of the bar 13, the end portion of strand 60 is clamped into the strand clamping means 38" of the carrier 21. The handle 65 of the jack mechanism 22 on the carrier 21 is then manually actuated so that the carrier 21 is drawn along the bar 13 by the interaction of the pawl 67 with the jack rack 14.

Without the presence of the wire clamp device 11, as in the case of known strand tighteners, it is necessary when the carrier 21 reaches the location on the bar 13 shown in FIG. 2, or only slightly closer to the strand holding means 20, to make a temporary tie between the end portions of strands 60 and 62 so as to be able to independently release the strand clamp means 38" of the carrier whereby the carrier can be moved back to end 17 of the bar 13. With the known structures, the strand 60 is then clamped again by the strand clamp means 38" of the carrier 21, the tie is undone, and the carrier is again advanced towards the strand holding means 20 to further pull strands 60 and 62 into more of an overlapping condition. These steps may have to be repeated a number of times, particularly if new wire is involved. This repetition is not only tedious, but each time it is repeated, some of the previous tightening is lost due to slippage in the tie which temporarily holds the strands together as the carrier is being repositioned and re-clamped. Furthermore, as the tightening of the strands is advanced, the operation becomes more dangerous in the event the temporary tie does not hold on release of strand clamp means 43 " of the carrier 21, or shortly thereafter as the carrier and its strand clamp means 43" are being reset.

However, in the structure of the present invention, the carrier 21 can be advanced past the position shown in FIG. 2 until it approaches the strand holding means 20 adjacent the end 16 of the bar 13 because it is not necessary to provide a temporary tie between the end portions of the strands 60 and 62. Instead the handle 37 of the wire clamping device 11 is moved to remove the upper portion of the dog member 50 from its closed condition, and the strand 60 then under tension is slid under the flange 45 of the block 43 and into channel 46 of the wire receiving means 42 in the wire clamp device 11. The channel 46 is substantially aligned with a like channel in the strand clamping means 38" of the carrier. The handle 37 is then released to cause the upper portion of the dog member to move back and clamp the strand 60 between the back 43 and the upper edge 58 of the dog member 51. Thus, the handle 37" of the strand clamping means 38" on the carrier 21 can be independently operated to allow release of the strand 60. The strands 60 and 62 remain safely held by the wire clamp device 11 and strand holding means 20 at opposite ends of the bar 13, while the jack mechanism is released to allow the carrier 21 to be slid back to the end 17 adjacent the wire clamp device 11 before the strand is re-clamped by the strand clamping means 38" of the carrier 21. While handle 37 of the wire clamp device 11 may then be moved to unclamp the strand 60, this is usually unnecessary because of the design of the clamp as described above. When the handle 65 of the jack mechanism 22 is again operated to force the carrier 21 towards the strand holding means 20, the clamp means 38 automatically releases to allow the wire to be pulled therethrough until the carrier 21 reaches its other limit of travel. As the strand 60 attempts to pull back, in the direction opposite to arrow A, the dog member again bites into the strand to prevent its withdrawal. Once the operation has been repeated a sufficient number of times to apply the required tightness of the strands 60 and 62, the ends are permanently fastened together and the strand clamp means 38 and/or 38" are released and the strand clamping means 38' is released as well to permit the overall structure 10 to be removed from the fence.

While the above operation has been described in relation to joining strands of fence wire, it should be appreciate that the same procedure can be used in tightening strands about cases, securing loads and like operation.

Figure 3:
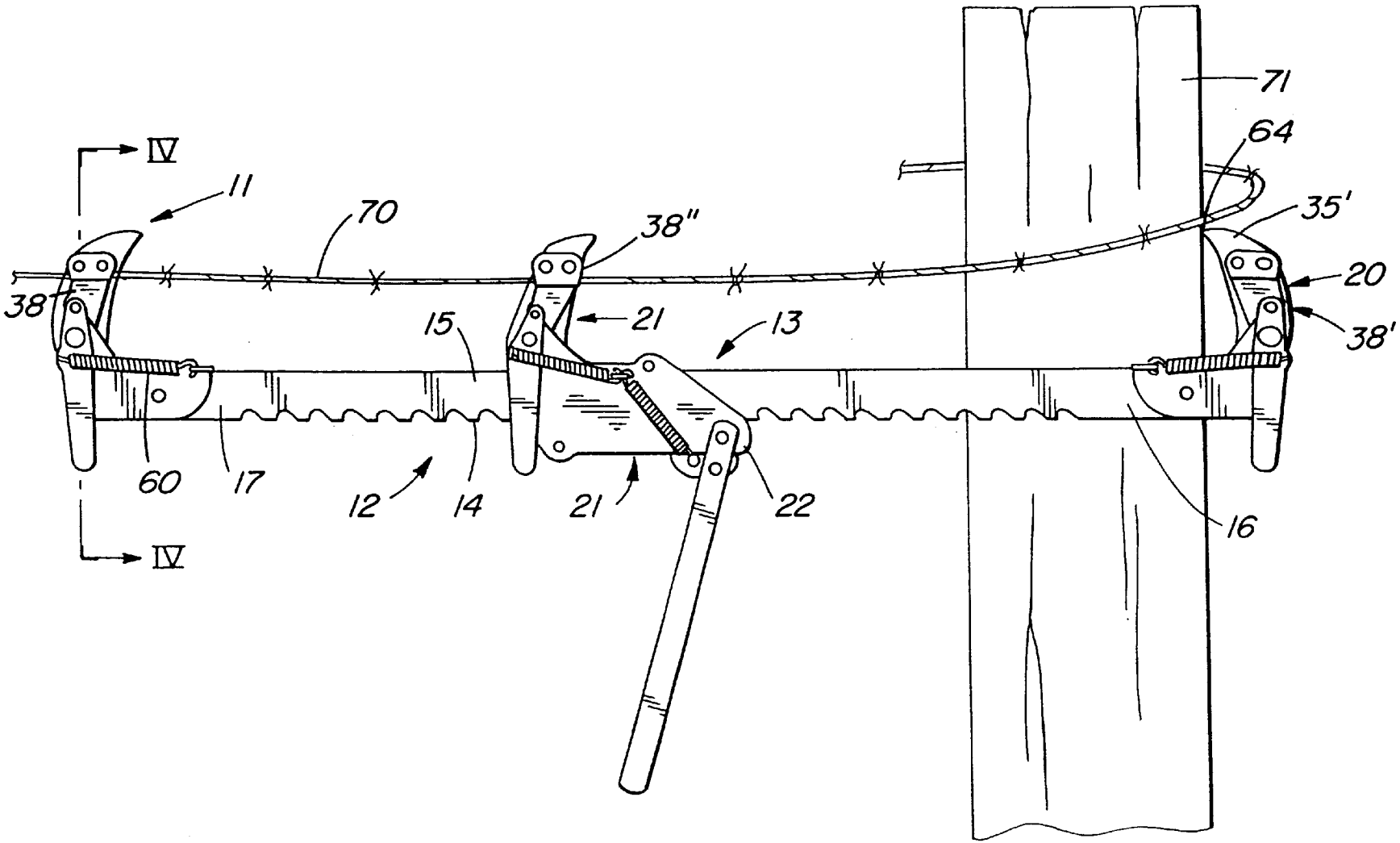
FIG. 3 is again a side view showing the overall structure like that of FIGS. 1 and 2 but illustrating the use of the structure in an alternative operation of joining an end of a single strand of barbed wire to a fence post.

FIG. 3 illustrates an operation in which a strand 70 of barb wire is being secured to a post 71. In this operation, the strand clamp means 38' of the strand holding means 20 is not utilized, rather the structure 10 is slightly tilted so that the curved edge 63 grabs the post or the point 64 bites into the post as the strand 70 is pulled toward the post, the strand holding means 20 thus acting as an anchor means in a different manner. In known devices it is necessary to tie the end about the post or temporarily staple it to the post in order to permit release of strand clamp means 38" on the carrier 21, for repositioning the carrier for further tensioning of the strand. In the present invention, once the carrier has been advanced to the end 16, the strand 17 is inserted in the strand clamp means 38 of the wire clamp device 11, allowing the release of the strand clamp means 38" of the carrier 21 to be released and the carrier 21 slid back along the bar 13, which is held against movement due to the tension on strand 70 and the engagement of the projecting portion 35' of the strand holding means 20 with the post 71. The strand clamp means 38" of the carrier 21 is again brought into engagement with strand 70 after which the strand clamping means of the wire clamp device 11 is released so that the carrier can be transferred by the jack mechanism 22 towards the post to apply further tension to the strand 70. When the strand 71 is sufficiently tensioned it is permanently attached to the post 71, at which time the strand clamp means 38 of the wire clamp device 11 and/or the strand clamp means 38" on the carrier 21 are released.

Figure 5:
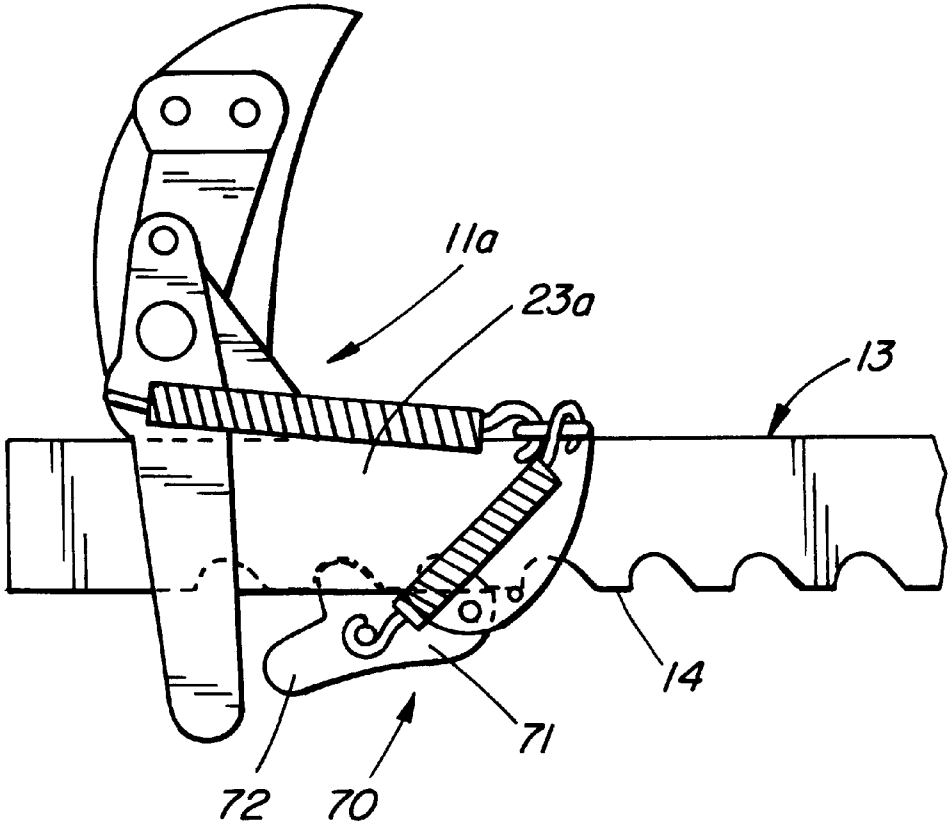
FIG. 5 is an enlarged side view of an alternative form of the clamp device installed on the left hand end of the bar.

In the illustrated embodiment, the wire clamp device 11 is shown as normally being rigidly and permanently affixed to the end 17 of the bar. As an alternative arrangement, the jack rack 14 could be extended further to the left on the bar, and the wire clamp device 11*a*, as shown in FIG. 5, could also be provided with a pawl arrangement 70 such as that shown for the jack mechanism 22, or the like, in the body thereof, whereby its position inward from the end of the bar could be more readily adjusted.

In this manner, the pawl arrangement 70 includes a pawl 71 which is pivotally mounted between the front and rear plates of the body portion 23*a* of the wire clamp device 11*a*. The pawl 71 is spring loaded so as to engage the jack rack 14 and thereby prevent movement of the wire clamp device 11*a* along the bar 13 unless the pawl is forced downwardly against the spring pressure by manually pressing on the downwardly projecting finger-engaging portion 72 of the pawl 71 should removal of the wire clamp device 11*a* or its adjustment along the bar be desired.

While a single embodiment of the invention has been illustrated and in the main described, it is apparent that various modifications could be made by those skilled in the art without departure from the spirit of the invention as defined in the appending claims.

What is claimed is:

1. A clamp device for use in a strand tightener of the type including:

an elongated rigid bar providing a jack rack throughout at least an intermediate portion between opposite ends thereof, a strand holding means stationarily affixed to said bar adjacent one end of said bar, a carrier having means for mounting said carrier on said intermediate portion of said bar for slideable movement along said bar, said carrier including a jack mechanism engageable with said jack rack for forcibly driving said carrier in a direction towards said strand holding means, said jack mechanism having a jack release means for allowing free return of said carrier in a direction away from said strand holding means, each of said strand holding means and said carrier including a projecting portion forming substantially aligned strand receiving channels therein, said carrier having a clamp means for holding one strand in said channel thereof and exerting a pull force on said one strand at least in the direction towards said strand holding means, said strand holding means having a clamp means independently operable of said clamp means of said carrier for holding a second strand in said channel thereof for exerting a holding force on said second strand at least in a direction toward said carrier;

said clamp device comprising a body portion provided with securing means for fastening said device in an operative position adjacent a second end of said bar, a projecting portion extending away from said body portion and defining a strand receiving channel for substantial alignment with said channel of said carrier when said body portion is affixed to said bar, and a strand clamping means carried by said body for holding said one strand in the channel thereof and exerting a holding force on said one strand at least in a direction towards said strand holding means, said strand clamping means of said clamp device being manually operated independent of said clamp means of both said strand holding means and said carrier.

2. A clamp device for use in a strand tightener of the type including:

an elongated rigid bar providing a jack rack throughout at least an intermediate portion between opposite ends thereof, a strand holding means stationarily affixed to said bar adjacent one end of said bar, a carrier having means for mounting said carrier on said intermediate portion of said bar for slideable movement along said bar, said carrier including a jack mechanism engageable with said jack rack for forcibly driving said carrier in a direction towards said strand holding means, said jack mechanism having a jack release means for allowing free return of said carrier in a direction away from said strand holding means, each of said strand holding means and said carrier including a projecting portion forming substantially aligned strand receiving channels therein, said carrier having a clamp means for holding a strand in said channel thereof and exerting a pull force on said one strand at least in the direction towards said strand holding means, said strand holding means having a clamp, means independently operable of said clamp means of said carrier for holding a second strand in said channel thereof for exerting a holding force on said second strand at least in a direction toward said carrier;

said clamp device comprising a body portion provided with securing means for fastening said device in an operative position adjacent a second end of said bar, a projecting portion extending away from said body portion and defining a strand receiving channel for substantial alignment with said channel of said carrier when said body portion is affixed to said bar, and a strand clamping means carried by said body for holding said one strand in the channel thereof and exerting a holding force on said one strand at least in a direction towards said strand holding means, said strand clamping means of said clamp device being manually operated independent of said clamp means of both said strand holding means and said carrier, said projecting portion of said clamp device including means defining said strand receiving channel as an inverted channel, and said clamping means of said clamp device means including a pivotally mounted, spring loaded dog means having an upper portion for projection up into said channel in a closed condition, said dog means having a slanted upper surface for engagement with said strand, said upper surface slanting upwards towards said carrier and terminating in sharp edge for biting into said strand only while exerting a holding force on said strand in a direction towards said carrier, whereby said strand may pull through said clamping means of said clamp device during movement of said carrier means in a direction towards said holding means.

3. A clamp device as defined in claim 2, and wherein said securing means of said body portion of said clamp device includes pawl means for engagement with said jack rack for normally holding said body portion of said clamp device secured in a fixed position relative to said bar when mounted thereon while permitting selected adjustment therealong.

4. A clamp device for use in a strand tightener of the type including:

an elongated rigid bar providing a jack rack throughout at least an intermediate portion between opposite ends thereof, a strand holding means stationarily affixed to said bar adjacent one end of said bar, a carrier having means for mounting said carrier on said intermediate portion of said bar for slideable movement alone said bar, said carrier including a jack mechanism engageable with said jack rack for forcibly driving said carrier in a direction towards said strand holding means, said jack mechanism having a jack release means for allowing free return of said carrier in a direction away from said strand holding means, each of said strand holding means and said carrier including a projecting portion forming substantially aligned strand receiving channels therein, said carrier having a clamp means for holding a strand in said channel thereof and exerting a pull force on said one strand at least in the direction towards said strand holding means, said strand holding means having a clamp means independently operable of said clamp means of said carrier for holding a second strand in said channel thereof for exerting a holding force on said second strand at least in a direction toward said carrier;

said clamp device comprising a body portion provided with securing means for fastening said device in an operative position adjacent a second end of said bar, a projecting portion extending away from said body portion and defining a strand receiving channel for substantial alignment with said channel of said carrier when said body portion is affixed to said bar, and a strand clamping means carried by said body for holding said one strand in the channel thereof and exerting a holding force on said one strand at least in a direction towards said strand holding means, said strand clamping means of said clamp device being manually operated independent of said clamp means of both said strand holding means and said carrier, said securing means of said body portion of said clamp device including pawl means for engagement with said jack rack for normally holding said body portion of said clamp device secured in a fixed position relative to said bar when mounted thereon while permitting selected adjustment therealong.

5. A strand tightener structure comprising;

an elongated rigid bar, said bar providing a jack rack at least throughout an intermediate portion between opposite ends of said bar, first and second holding means one each fixed stationary relative to said bar adjacent one each of said opposite ends of said bar, and a carrier having means for mounting said carrier on said intermediate portion for slideable movement therealong in either direction, said carrier including a jack mechanism engageable with said jack rack for forcibly driving said carrier at least in one direction towards said first holding means upon manual operation of said jack mechanism, said carrier having release means for releasing said jacking mechanism for allowing return of said carrier in a direction opposite to said one direction and towards said second holding means, each of said holding means and said carrier including a projecting portion extending in a direction substantially normal to said bar, a strand receiving channel formed in each of said projecting portions of said holding means and carrier, the strand receiving channel of each of said holding means and said carrier being substantially aligned along an axis substantially parallel to said bar, said first holding means including a clamping means for selective actuation into a position for engaging an end portion of a first strand in the strand receiving channel of said first holding means and exerting a holding force on said first strand in a direction opposite to said one direction, said carrier including a clamping means for selective actuation into a position for engaging an end portion of a second strand in the strand receiving channel of said carrier and exerting a pull force on said second strand at least in a direction towards said first holding means, said second holding means including clamping means for selective actuation into a position for engaging said end portion of a second strand and exerting a holding force on said second strand in a direction the same as said direction of said pull force exerted by said clamping means of said carrier, said clamping means of said holding means and said carrier each being individually operable between the strand engaging position and a wire release position.

6. A method of tensioning a strand by way of a strand tightener, said strand tightener being of the type including an elongated rigid bar providing a jack rack throughout at least an intermediate portion between opposite ends thereof, an anchor means affixed to said bar adjacent one end of said bar, and a carrier having means for mounting said carrier on said intermediate portion of said bar for slideable movement along said bar, said carrier including a jack mechanism engageable with said jack rack for forcibly driving said carrier in a direction towards said anchor means, said jack mechanism having a jack release means for allowing free return of said carrier in a direction away from said anchor means, each of said anchor means and said carrier including a projecting portion extending outwardly from a longitudinal axis of said bar, said projection portion of said carrier forming a channel extending substantially parallel to said bar for receiving a strand to be tightened, said carrier including a strand holding means for holding said strand in said channel thereof for exerting a pull force on said strand at least in a direction towards said anchor means, said anchor means including holding means for attachment of said strand tightener to a member at the strand tightening site to resist movement of said bar in a direction towards a second end thereof opposite to said one end, said method comprising the steps of:

1) affixing a clamp device to said bar adjacent the second end of said bar, said clamp device comprising a body portion, a projecting portion extending away from said body portion and defining a strand receiving channel for substantial alignment with said channel of said carrier when said body portion is affixed to said bar, and a strand clamping means carried by said body for holding said strand in said channel of said clamp device and exerting a holding force on said strand at least in a direction towards said anchor means;

2) connecting said holding means of said anchor means to said member at the strand tightening site;

3) positioning said carrier on said bar adjacent said clamp device;

4) inserting said strand into said channel of said carrier and engaging said strand holding means of said carrier to prevent movement of said strand in a direction towards said second end of said bar;

5) operating said jack mechanism to move said carrier towards said one end of said bar to thereby draw said strand in a strand tightening direction towards said anchor means;

6) ensuring entry of said strand into said strand receiving channel of said clamp device and activation of said clamping means of said clamp device for preventing movement of said strand in a direction opposite to said strand tightening direction;

7) independently releasing said strand holding means of said carrier;

8) repeating steps 3) and 5) while ensuring at least partial release of said clamping means of said clamp device to allow said strand to pull past said clamp device;

9) repeating step 7);

10) repeating steps 8) and 9) until the strand is sufficiently tightened;

11) releasing said strand holding means of said carrier;

12) securing said strand to said member at said strand tightening site;

13) subsequently releasing said clamp means of said clamp device; and 14) releasing said holding means of said anchor means from said member, at said strand tightening site for allowing removal of said strand tightener from said strand tightening site.

7. The method of claim 6, wherein;

said member at said strand tightening site is an end of a second strand, said holding means of said anchor means includes a channel formed by said projecting portion of said anchor means for receiving said end of a second strand, said channel being substantially aligned with said channel formed by said projecting portion of said carrier, said holding means of said anchor means including a clamp means for holding said second strand in said channel and exerting a pull force on said second strand at least in a direction towards said second end of said bar; and wherein, step 2) includes inserting said end of said second strand in said channel and ensuring closure of said clamp means of said holding means, step 12) includes interconnecting said first and second strands; and step 14) includes releasing said clamp means of said anchor means.

8. The method of claim 6, wherein;

said member at said strand tightening site is a post, said holding means of said anchor means includes a post engaging surface facing said carrier on said projecting portion of said anchor means, and wherein, step 2) includes hooking said post engaging surface against a side of the post opposite to said carrier, step 12) includes securing said strand about said post, and step 14) includes disengaging said post engaging surface of said projecting portion of said anchor means from said post.

* * * * *